US006798131B2

(12) United States Patent
Fink et al.

(10) Patent No.: US 6,798,131 B2
(45) Date of Patent: Sep. 28, 2004

(54) DISPLAY HAVING A GRID ELECTRODE WITH INDIVIDUALLY CONTROLLABLE GRID PORTIONS

(75) Inventors: Richard Lee Fink, Austin, TX (US); Zvi Yaniv, Austin, TX (US)

(73) Assignee: SI Diamond Technology, Inc., Austin, TX (US)

( * ) Notice: Subject to any disclaimer, the term of this patent is extended or adjusted under 35 U.S.C. 154(b) by 94 days.

(21) Appl. No.: 10/002,055

(22) Filed: Nov. 15, 2001

(65) Prior Publication Data

US 2002/0089278 A1 Jul. 11, 2002

Related U.S. Application Data

(60) Provisional application No. 60/252,109, filed on Nov. 20, 2000.

(51) Int. Cl.[7] ..... H01J 1/02

(52) U.S. Cl. ..... 313/495; 315/169.1

(58) Field of Search ..... 313/495–497, 313/309, 311, 336, 351, 355, 310, 422; 315/169.1, 169.3

(56) References Cited

U.S. PATENT DOCUMENTS

| | | | | | |
|---|---|---|---|---|---|
| 3,808,477 | A | * | 4/1974 | Swank | 313/348 |
| 4,575,765 | A | * | 3/1986 | Hirt | 313/309 |
| 5,063,327 | A | * | 11/1991 | Brodie et al. | 313/495 |
| 5,210,472 | A | | 5/1993 | Casper et al. | 315/349 |
| 5,410,218 | A | | 4/1995 | Hush | 315/169.1 |
| 5,459,480 | A | | 10/1995 | Browning et al. | 345/75 |
| 5,589,731 | A | * | 12/1996 | Fahlen et al. | 313/495 |
| 5,616,991 | A | | 4/1997 | Casper et al. | 315/167 |
| 5,627,436 | A | | 5/1997 | Suzuki et al. | 315/169.1 |
| 5,642,017 | A | | 6/1997 | Hush | 315/169.3 |
| 5,656,892 | A | | 8/1997 | Zimlich et al. | 315/169.3 |
| 5,754,149 | A | | 5/1998 | Browning et al. | 345/75 |
| 5,856,812 | A | | 1/1999 | Hush et al. | 345/74 |
| 5,867,136 | A | | 2/1999 | Zimlich | 345/74 |
| 5,894,293 | A | | 4/1999 | Hush et al. | 345/74 |
| 5,903,092 | A | * | 5/1999 | Akama | 313/311 |
| 5,909,203 | A | | 6/1999 | Browning et al. | 345/75 |

FOREIGN PATENT DOCUMENTS

| | | |
|---|---|---|
| EP | 0 649 162 B1 | 4/1995 |
| WO | WO 97/15912 | 5/1997 |

OTHER PUBLICATIONS

Junji Itoh, "A New Actively–Controllable Si FEA for FED Application," IDW '96 Proceedings of The Third International Display Workshops, *SID Japan Chapter*, Nov. 27–29, 1996 International Conference Center Kobe, Japan, pp. 155–158.

H. Gamo et al., "Actively–Controllable Field Emitter Arrays with Built–in Thin–Film Transistors on Glass for Active–Matrix FED Applications," IDW '98 Proceedings of The Fifth International Display Workshops, *SID Japan Chapter*, Dec. 7–9, 1998 International Conference Center Kobe, Japan, pp. 667–670.

T. Matsukawa et al., "Structure Optimization of Transistor–Based Si Field Emitter Arrays," IDW '98 Proceedings of The Fifth International Display Workshops, *SID Japan Chapter*, Dec. 7–9, 1998 International Conference Center Kobe, Japan, pp. 671–674.

* cited by examiner

*Primary Examiner*—Joseph Williams
(74) *Attorney, Agent, or Firm*—Kelly K. Kordzik; Winstead Sechrest & Minick P.C.

(57) ABSTRACT

A multiplexed grid structure for electron emission displays allows each of the grid portions to be independently controllable from each other so that electrons can be emitted from their respective pixel sites as each grid portion is addressed.

19 Claims, 8 Drawing Sheets

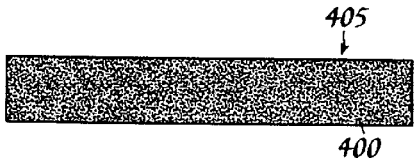
Fig. 4A
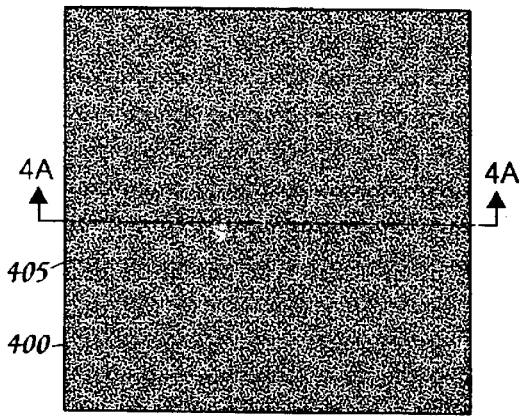
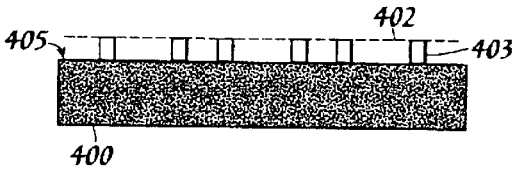
Fig. 4B
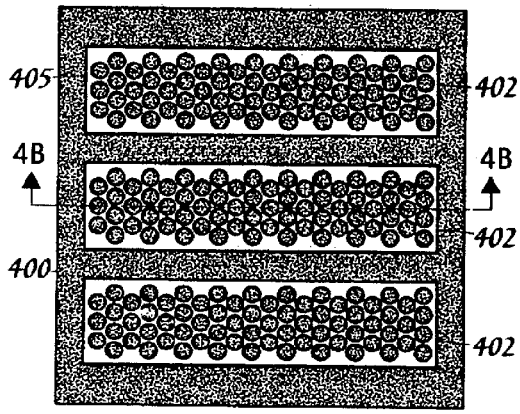
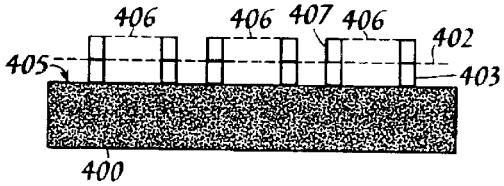
Fig. 4C
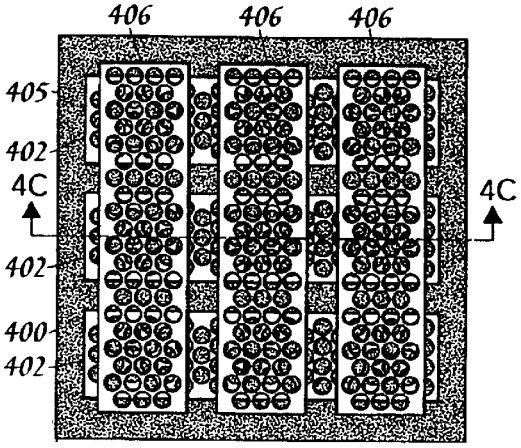

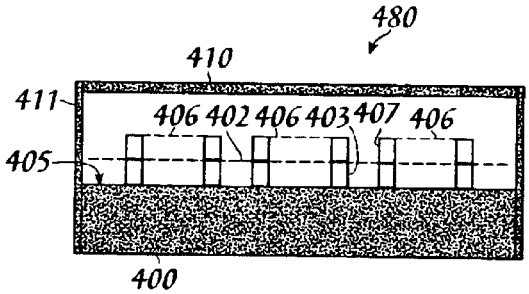
Fig. 4D
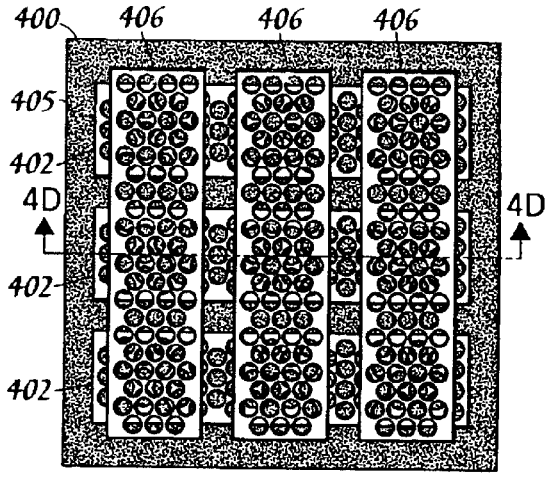

DISPLAY HAVING A GRID ELECTRODE WITH INDIVIDUALLY CONTROLLABLE GRID PORTIONS

This application claims benefit of 60,252,109, filed Nov. 20, 2000.

BACKGROUND INFORMATION

For over 50 years, the cathode ray tube (CRT) has been the principal device for displaying visual information. Although the CRT provides remarkable display quality in terms of brightness, color, contrast and resolution, it is large, bulky and power hungry. It is not a technology that can be portable and easily scaled to large sizes (50" diagonal or larger). Several display technologies are in development or matured to manufacturing that try to fill this void.

As one of these technologies, field emission displays (FEDs) have been under development for several years now. They have the promise of providing CRT-like image quality in a thin, compact and lightweight form. FEDs rely on cold cathode technology as the source of electrons that are controlled and accelerated to the phosphor-coated faceplate. The impact of the electrons on the phosphor creates the light that is used to form the image. Different phosphors are used to create the red, green and blue colors, as in a CRT.

The cold cathodes used in FEDs vary from arrays of semiconductor or metal microtips, coatings of a variety of carbon films on microtip arrays or on flat surfaces, and coatings of wide-bandgap materials. The carbon films span a complete range of materials from diamond or diamond-like coatings, graphitic, amorphous, Amorphic™, carbon nanotubes and other fullerene carbon phases, and mixtures of any and all of these phases. Other cold cathode technologies are microtips structures with a coating of carbon or other materials to lower work function, to harden the tip, or sharpen the tip. The disclosure described herein is relevant to any and all of these cold cathode technologies.

Most of the microtip technologies have developed such that the field that is used to extract electrons from the tips comes from the electrical potential difference between a gate electrode placed around the tips and the tips themselves. FIG. 1 shows the prior art in microtip technology. Typically, the gate 11A, 11B, 11C is built and integrated onto the same substrate 12A, 12B, 12C as is used to support the microtips 13. One problem with this and other cold cathode technologies has been to control the current emitted from the cathode. In microtip technologies, this is done by electrically connecting the microtips or arrays of microtips to the electrical bus lines that define the rows or columns in the display through a passive resistor or an active circuit containing diodes, capacitors, and transistors. FIGS. 2 and 3 are examples of prior art. In both examples, circuits on the cathode that link directly to the tip control the current emitted from the tip. For example in FIG. 2, transistors on the substrate at each pixel switch the current to the microtip array. In FIG. 3, the active circuits are external to the display panel, but still perform the same function of controlling the microtip emission current through circuits linked directly to the microtips. In these examples the gate is either common to all pixels in the display or the gate electrode is separated into rows and the each gate row is common to all pixels in that row, and the active elements that control the emission current control the tip electrode and not the gate electrode. Although this approach may work well for microtips, for other cold cathode technologies it may be impractical.

Many of the carbon film cold cathode approaches require high temperature to grow or fabricate the carbon layer. This means that the substrate must be able to withstand high growth temperatures, above the point at which glass is not a suitable choice. In other cases, glass or other insulating substrates may not be suitable since for certain carbon film growth techniques, such as plasma enhanced DC-CVD, a conducting substrate is needed, or at the very minimum, a conducting layer on the insulating substrate. High temperature glass or ceramic substrates are expensive and break easily when subjected to thermal gradients. One choice of substrate material on which to grow carbon films is steel sheets, such as 304 stainless steel or stainless alloys such as 42-6 (a stainless alloy containing 42% Ni, 6% Cr). Stainless sheets are relatively inexpensive. One can purchase highly polished 304 stainless plates for $4.00 a square foot or less, and it is readily available since it is used commercially to cover walls of buildings and build metal furniture. Steel substrates are strong, handle thermal stress much better then glass, and are impervious to air so they can hold a vacuum like glass.

The problem with putting a cathode material on a conducting substrate such as silicon (Si) or metal is that it is difficult to electrically isolate the pixel areas and the electrical buslines connecting and controlling the pixel areas. One can deposit insulating layers on top of the conducting substrate, but this may again interfere with certain carbon layer growth techniques. Furthermore, even with an isolated layer between the buslines and the conducting plate, the parasitic capacitance between the buslines and the conducting ground plane would cause excessive power dissipation during display operation as elements are being constantly and rapidly electrically switched from one state to another.

Another problem is that multilayer structures do not survive well in the high temperature growth processes performed in carbon-rich atmospheres. Adhesion of different layers becomes more difficult at higher temperatures because of stresses developed in the different layers as a result of differences in thermal expansion. Furthermore, carbon layers or fibers can easily grow across edges of insulating films and thus electrically short conducting layers together. Thus, a solution is required to overcome these difficulties.

BRIEF DESCRIPTION OF THE DRAWINGS

FIGS. 4A–4D illustrate construction of an embodiment of the present invention;

DETAILED DESCRIPTION

Figure 1:
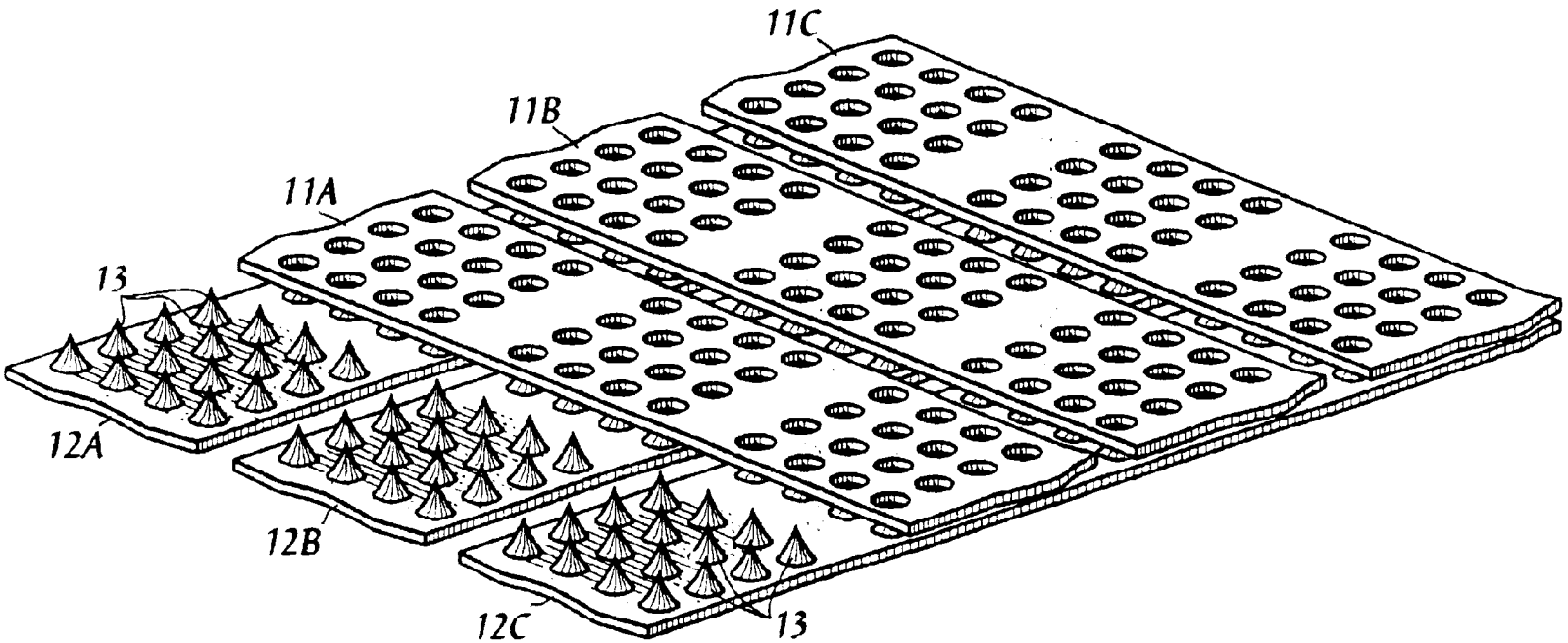
Fig. 1 (PRIOR ART)
FIG. 1 illustrates prior art microtip cathode and grid assemblies.
Figure 2:
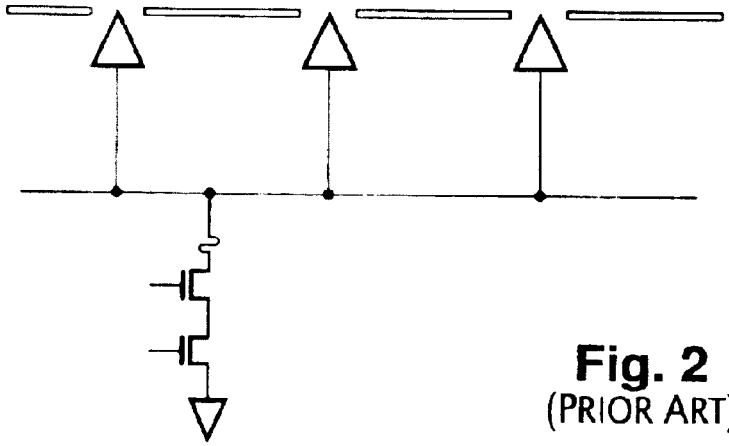
Fig. 2 (PRIOR ART)
FIG. 2 illustrates a prior art circuit for energizing a microtip cathode.
Figure 3:
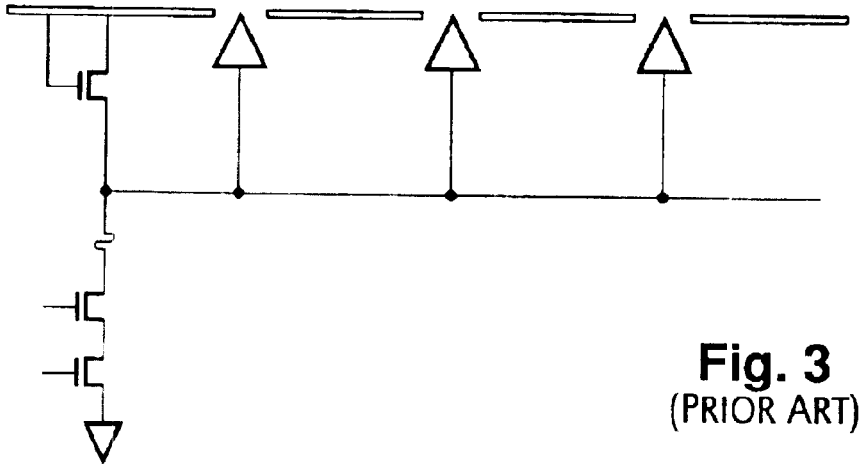
Fig. 3 (PRIOR ART)
FIG. 3 illustrates a prior art circuit for energizing a microtip cathode.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted in as much as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

One solution for making a pixilated and addressable electron source or display is to not pixilate the cathode into many individual, electrically isolated areas, but to ground all pixels on the cathode to a common electrical lead and to use the grid to achieve addressability. Furthermore, the grid is demountable and can be attached to the cathode substrate after the carbon film is deposited; thus the grid structure does not have to withstand the high temperature, carbon rich environment that the cathode is exposed to. This allows inexpensive substrate material such as steel alloys or stainless steel alloys to be used for making FEDs. This also allows the use of all of the current control circuits invented to control emission current from emission sites, sub-pixel arrays and pixel arrays and placed on cathode circuits to be used instead on circuits fabricated on the grid substrate, and still perform the same function.

There are several embodiments to this invention.

A first embodiment is what could be called a passive, matrix-addressable grid structure. FIGS. 4A–4D show cathode and grid assembly illustrating the concept. Referring to FIG. 4A, a cathode is fabricated by placing a layer of cold cathode material 405 on a substrate 400 that can be any material and can be conducting, insulating or semiconducting. The cold cathode layer 405 can be patterned or not patterned. If the substrate 400 is not conducting, a conducting layer (not shown) may be placed between the cold cathode layer 405 and the substrate 400.

Referring to FIG. 4B, on top of the cold cathode layer 405, a series of long and narrow grid structures 402 can be placed. Insulating posts 403 or other electrically insulating support structures separate the grids 402 from the cold cathode layer 405 and hold them at a constant and well defined gap away from the cold cathode layer 405. The grids 402 in this layer are separated also from each other by another gap but are placed parallel to each other. This layer is the row grid layer.

Referring to FIG. 4C, on top of the row grid layer is place another series of long and narrow grid structures 406 with insulating posts 407 or other electrically insulating support structures separating this grid layer 406 from the row grid layer 402 at a constant and well defined gap. This layer is the column grid layer. The column grid layer 406 is placed in a direction that is perpendicular with the row grid layer 402.

Alternatively, the column grid layer 406 can be between the cathode layer 405 and the row grid layer 402. Additionally, the cathode layer can be patterned such that there is a cold cathode layer only in the areas defined by the intersection of the row and column grids. By sealing the assembly as shown in FIG. 4D to side walls 411 and a phosphor coated faceplate 410 to create an enclosed vacuum vessel and evacuating the volume of the vessel, one can make a display device 480 suitable for showing images.

This device 480 is operated as a matrix-addressed electron source by biasing a row grid 402 positive with respect to the cathode layer 405 such that the electric field between the row grid 402 and cathode layer 405 is sufficient to extract electrons from the cold cathode layer 405. The voltage applied to the row grid 402 is dependent on the gap between the cathode layer 405 and the grid layer 402, and dependent on the emission properties of the cold cathode layer 405. By sufficiently biasing the row grid layer 402, electrons are extracted from the cold cathode layer 405 that is under the grid layer 402. Some of these electrons travel through the grid 402. The electron beams in that row are further modulated biasing the column grids 406 (control lines). If a column grid 406 is biased at the same potential as the row grid 402, some of the electrons that pass through the row grid 402 then pass through the column grid 406 for that column-row intersection (pixel). If the column grid 406 is biased at a potential near or about 20% more negative than the cold cathode layer 405, then the electron beam is not allowed to penetrate the column grid layer 406 and that pixel is off.

The intensity of the beams from this addressable electron source can be modulated in two ways, (1) by pulse width modulation, or (2) by voltage control of the control grid. By controlling the beam intensities by either means, both static or video images can displayed in a display device 480 using this assembly by biasing each row on in sequence and modulating the intensity of the beams from the pixels in each row. Typically, the entire sequence of turning on all of the rows once for one image frame takes about 1/60 of a second. Typically, 50–60 frames are imaged in a second.

An embodiment of this invention is to actively drive the grid structure.

Figure 5:
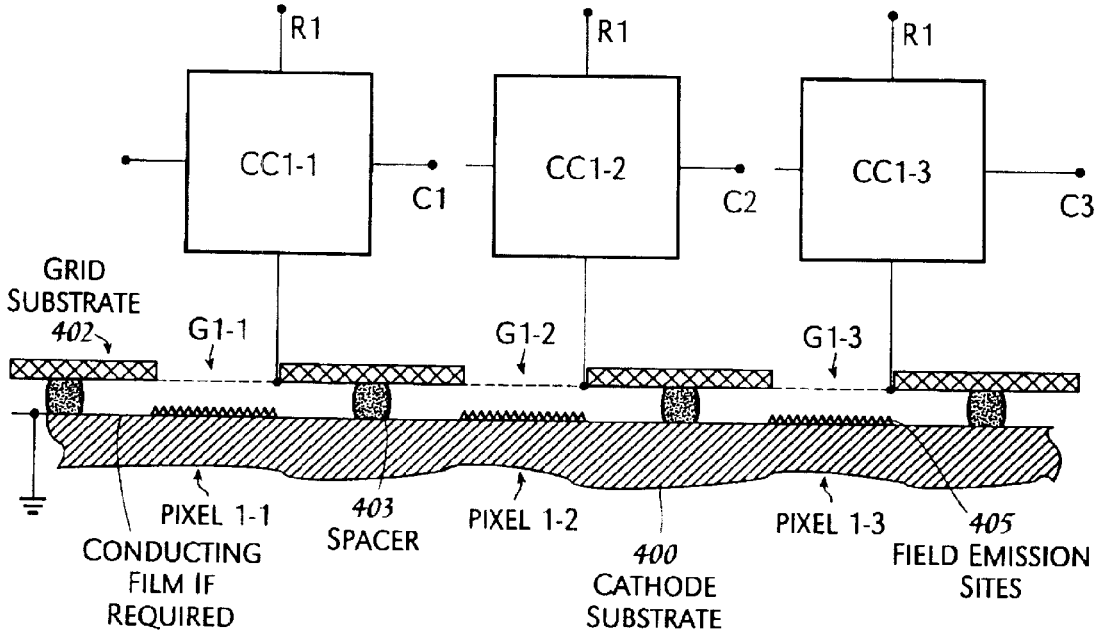
FIG. 5 illustrates a circuit diagram of an embodiment of the present invention.

FIG. 5 illustrates the concept of an active grid mounted onto a cathode. The cathode may use a substrate 400 that is conducting, semiconducting or insulating. If required, a conducting layer may be deposited on the surface of the substrate 400 to electrically connect the emission areas 405 to a common electrode (e.g., ground). Emission areas 405 are deposited or placed on the cathode substrate surface 400. These emission areas 405 can be microtips, cold cathodes made of carbon materials, or wide band gap materials that emit electrons. In fact, this concept can be used for an array of hot cathodes as well. It can be used for field emitters that are grown on a different substrate and mounted as separate chips on the main cathode substrate shown in FIG. 5. The emission areas 405 may or may not be patterned, and may be located under the grid areas to be described next.

An active grid is fabricated such that independently addressable conducting or semiconducting grids are placed on a grid substrate 402. In this case, the grid substrate 402 can be glass or other insulating material with an array of holes (see FIGS. 4A–4D) that define the pixel and sub-pixel arrays. The grids are labeled G1-1, G1-2 and G1-3 in FIG. 5. Each grid G1-1, G1-2, G1-3 is electrically isolated from all others in the array. The grids can be formed by well known methods. One method is called electroforming, a process in which grid material is electrically plated to a thickness of as much as 25 microns or more, but typically 12 microns. The plating is preformed in such a manner to form a patterned grid material by allowing the plating to proceed in well defined areas. Another method of making a grid is to chemically or physically etch holes in a pattern in a metal foil or sheet. FIG. 5 shows only 3 grids in a linear array, but in actuality, the grid arrays may be two-dimensional (2-D) arrays that contain hundreds of rows and columns (see FIGS. 4A–4D). Spacers 403 between the grid substrate 402 and the cathode substrate 400 hold the gap between the emission areas and the grids. An alternative approach is to use the grid substrate itself as the spacer and bond the grids to the side of the grid substrate opposite the cathode substrate.

Each grid is controlled by a control circuit (CC) labeled in FIG. 5 as CC1-1, CC1-2 and CC1-3 for pixels 1-1, 1-2 and 1-3 respectively. The CCs are controlled by row and column control signals that are associated with that particular pixel, i.e. pixel 1-2 is controlled by Row 1 signals (R1) and Column 2 signals (C2). These signals can be high voltage or low voltage (standard CMOS, NMOS, TTL and other integrated circuit signal levels generally 5 V or less). They can even be mixed with high voltage signals on the column lines and low voltage signals on the row lines or the other way around. What signal levels are used is dependent on the circuit used in the grid control circuits.

Figure 6:
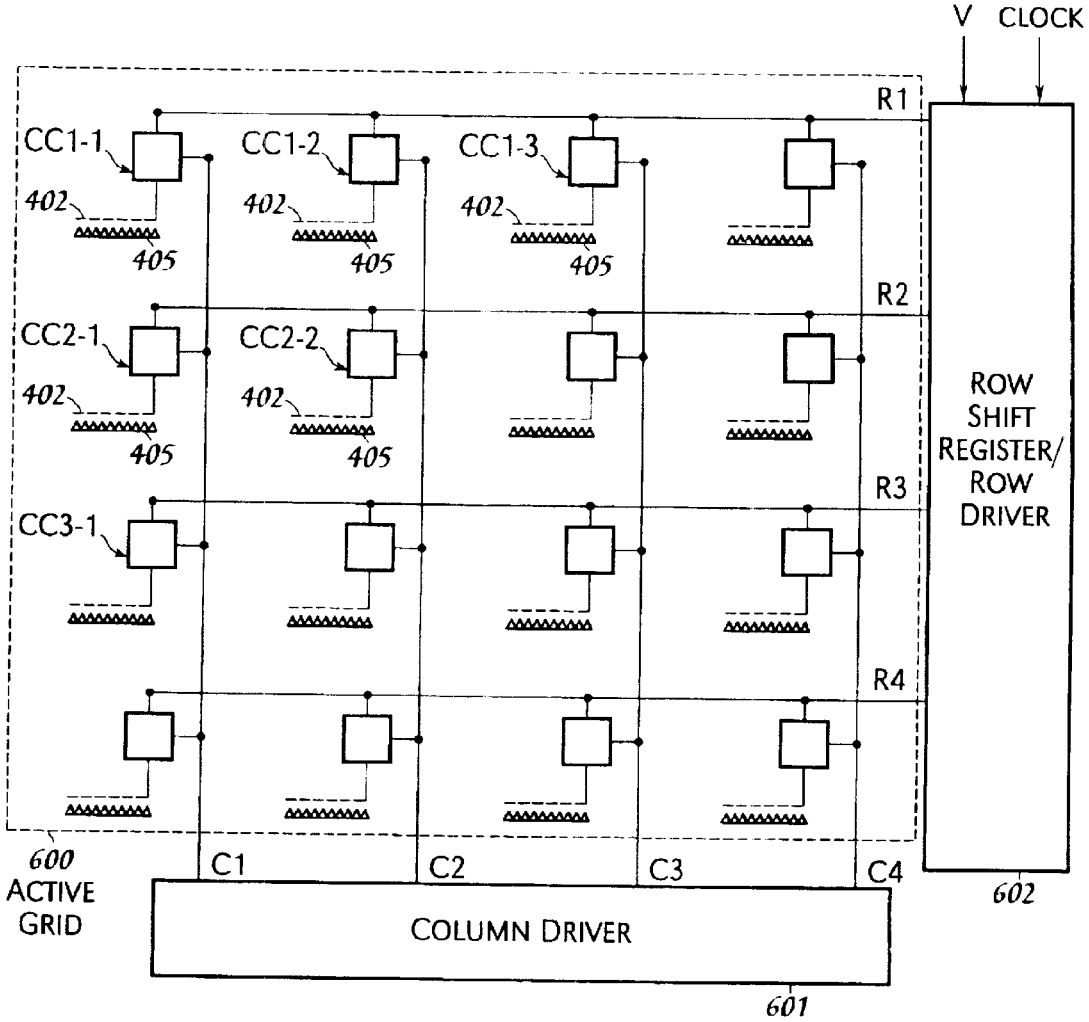
FIG. 6 illustrates a circuit diagram of an embodiment of the present invention.

FIG. 6 illustrates a 2-D view of the electrical circuit of a 4×4 pixel active grid 600 with cathode. The emission areas 405 of the cathode are at a common potential. The grids are controlled by the grid control circuits such that when required, the electrical potential on each grid is brought to a level sufficiently positive with respect to the cathode potential such that electrons are emitted from the cathode emitter material 405 at a current level sufficient to illuminate the phosphor (see FIG. 4D) to a determined brightness. In a typical mode of operation, the grid CCs in one row are activated by a signal from the row driver (e.g., R1) and propagated along the control line for that row. The column driver then controls the intensity of the electron beam emitted by that pixel by controlling the time that the grid is at the driving potential (e.g., pulse width modulation using a clock signal) or by adjusting the voltage level (V) on the grid to a value corresponding to the required emission intensity(analog modulation).

Figure 7:
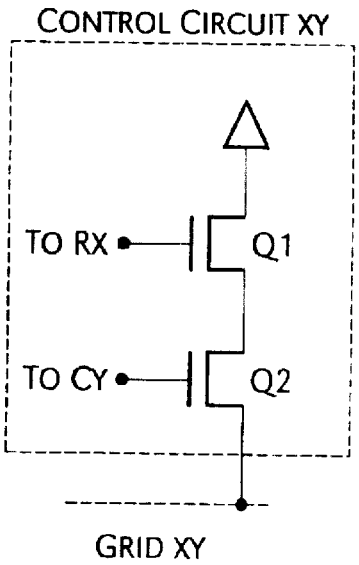
FIG. 7 illustrates a circuit diagram of an embodiment of the present invention.
Figure 8:
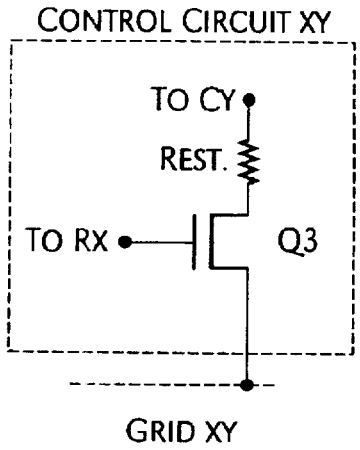
FIG. 8 illustrates a circuit diagram of an embodiment of the present invention.

FIGS. 7 and 8 illustrate examples of grid control circuits (e.g., CC1-1, CC1-2, . . . ). There are many other possible circuit configurations. The FIG. 8 circuit requires fewer active devices Q3 and requires only row, column and ground level connections than the circuit in FIG. 7. The circuit in FIG. 7 also requires contact to another separate voltage signal that is brought to every grid control circuit.

A multiplexed grid structure for field emission displays is disclosed. This structure is used when the cathode contains an array of emission areas that are linked electrically to one common potential. The proposed grid structures allow one to achieve an addressable electron source when using these cathodes. These addressable electron sources can be used for display applications. The grid structures can be passive or active. Active structures have an advantage in that they can be made separate from the cathode structure and then assembled with the cathode to make the addressable source. An advantage here is that the grid structure then does not have to be subjected to extreme process conditions that the cathode may be exposed to, especially for carbon based cathodes.

Figure 9:
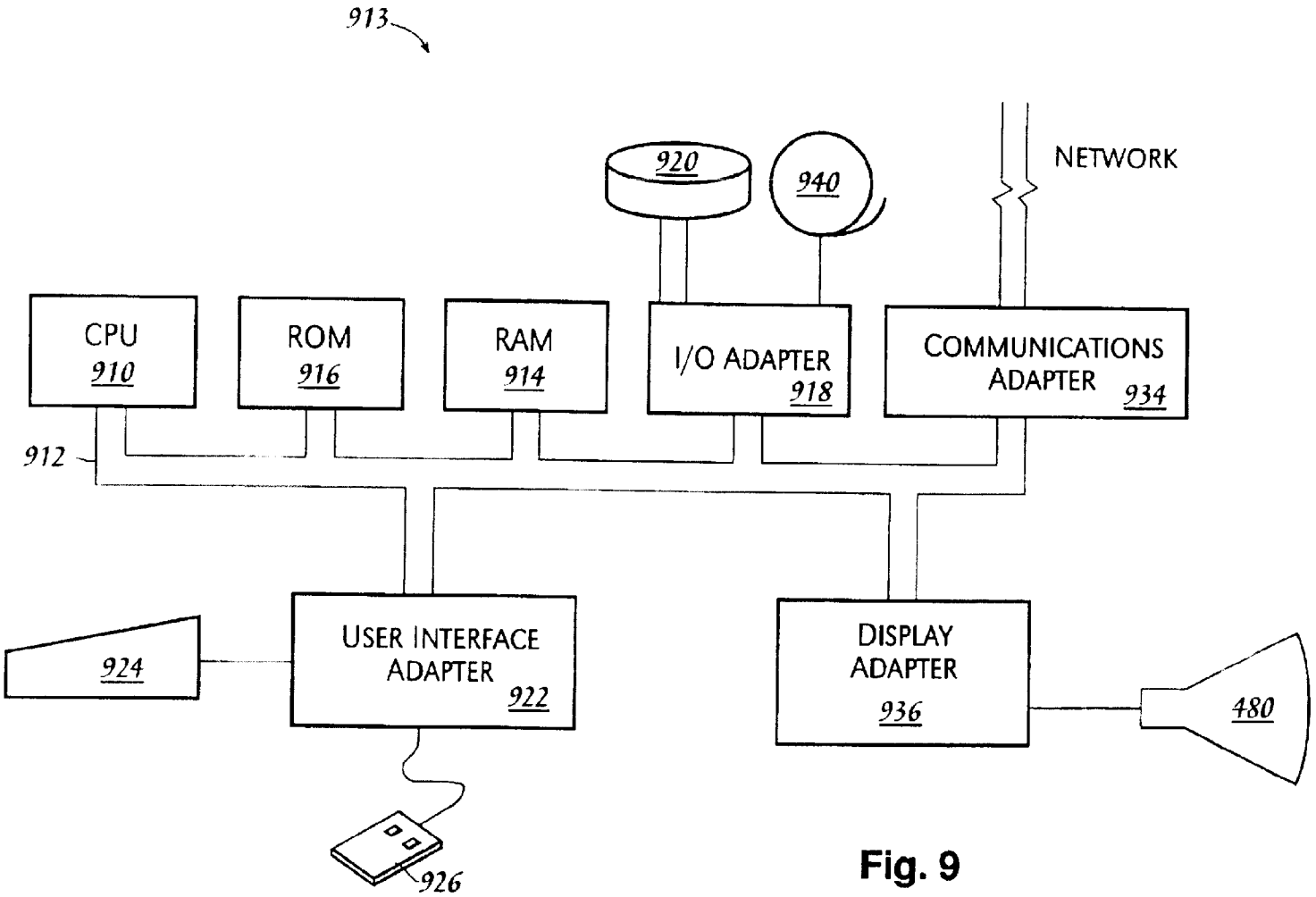
FIG. 9 illustrates a data processing system configured in accordance with the present invention .

A representative hardware environment for practicing the present invention is depicted in FIG. 9, which illustrates an exemplary hardware configuration of data processing system 913 in accordance with the subject invention having central processing unit (CPU) 910, such as a conventional microprocessor, and a number of other units interconnected via system bus 912. Data processing system 913 includes random access memory (RAM) 914, read only memory (ROM) 916, and input/output (I/0) adapter 918 for connecting peripheral devices such as disk units 920 and tape drives 940 to bus 912, user interface adapter 922 for connecting keyboard 924, mouse 926, and/or other user interface devices such as a touch screen device (not shown) to bus 912, communication adapter 934 for connecting data processing system 913 to a data processing network, and display adapter 936 for connecting bus 912 to display device 480. CPU 910 may include other circuitry not shown herein, which will include circuitry commonly found within a microprocessor, e.g., execution unit, bus interface unit, arithmetic logic unit, etc.

The present invention can also be applied to a display device as disclosed in U.S. patent application Ser. No. 09/016,222, which is hereby incorporated by reference herein.

What is claimed is:

1. A display apparatus comprising:

a cathode having an electron emissive material;

a plurality of grid portions positioned in proximity to the cathode, the plurality of grid portions each defining a single pixel site independent of other pixel sites; and control circuitry for controlling each of the plurality of grid portions to independently cause an emission of electrons from the electron emissive material at each pixel site, wherein the plurality of grid portions are each electrically isolated from each other.

2. The display apparatus as recited in claim 1, wherein the plurality of grid portions are substantially coplanar with each other.

3. The display apparatus as recited in claim 1, wherein the plurality of grid portions further comprises a first grid portion, a second grid portion, and a third grid portion, and wherein the control circuitry is operable for activating the first, second, and third grid portions individually from each other.

4. The display apparatus as recited in claim 3, wherein the plurality of grid portions are substantially coplanar with each other.

5. The display apparatus as recited in claim 3, wherein the first, second, and third grid portions are mounted on a grid substrate.

6. A display apparatus comprising:

a cathode having an electron emissive material;

a plurality of grid portions positioned in proximity to the cathode, the plurality of grid portions each defining a single pixel site; and control circuitry for controlling each of the plurality of grid portions to independently cause an emission of electrons from the electron emissive material at each pixel site, wherein the plurality of grid portions further comprises a first grid portion, a second grid portion, and a third grid portion, and wherein the control circuitry is operable for activating the first, second, and third grid portions individually from each other, wherein the first, second, and third grid portions are electrically isolated from each other.

7. A display apparatus comprising:

a cathode having an electron emissive material deposited thereon; first, second, and third grid portions each defining a single pixel site; and a first control circuit for controlling activation of the first grid portion so as to control an emission of electrons from the electron emissive material proximate to the first grid portion;

a second control circuit for controlling activation of the second grid portion so as to control an emission of electrons from the electron emissive material proximate to the second grid portion;

a third control circuit for controlling activation of the third grid portion so as to control an emission of electrons from the electron emissive material proximate to the third grid portion, wherein the first, second, and third control circuits operate to control the first, second, and third grid portions independently from each other, wherein the first, second, and third grid portions are electrically isolated from each other.

8. The display apparatus as recited in claim 7, wherein the first, second, and third control circuits are operated in a matrix-addressable manner.

9. The display apparatus as recited in claim 7, wherein the first, second, and third grid portions are substantially coplanar.

10. The display apparatus as recited in claim 7, wherein the electron emissive material is a cold cathode.

11. The display apparatus as recited in claim 7, wherein the electron emissive material is a hot cathode.

12. The display apparatus as recited in claim 7, wherein the first control circuit operates to apply a voltage to the first grid portion to cause an emission of electrons from the electron emissive material in proximity to the first grid portion, wherein the second control circuit operates to apply a voltage to the second grid portion to cause an emission of electrons from the electron emissive material in proximity to the second grid portion; wherein the third control circuit operates to apply a voltage to the third grid portion to cause an emission of electrons from the electron emissive material in proximity to the third grid portion.

13. A display apparatus comprising:

a cathode; and a grid electrode having a plurality of individually controllable grid portions each for controlling emissions of electrons from a single pixel of the cathode.

14. The display apparatus as recited in claim 13, wherein the grid portions are controllable in a matrix-addressable manner.

15. The display apparatus as recited in claim 13, wherein the grid portions are coplanar.

16. The display apparatus as recited in claim 14, wherein the grid portions are actively addressed.

17. A display apparatus comprising:

a cathode having an electron emissive material;

a grid electrode positioned in proximity to the cathode, the grid electrode having N grid portions, each of the N grid portions defining a single N pixel element; and control circuitry for independently controlling each of the N grid portions to cause an emission of electrons from the electron emissive material at each of the N pixel elements.

18. The display apparatus as recited in claim 17, wherein the control circuitry at each of the N pixel elements is configured to cause an emission from only that particular pixel element in the display.

19. A display apparatus comprising:

a cathode having an electron emissive material;

a grid electrode positioned in proximity to the cathode, the grid electrode having a plurality of grid portions each defining a single pixel site; and control circuitry for controlling each of the plurality of grid portions to independently cause an emission of electrons from the electron emissive material at each pixel site.

* * * * *